US008039188B2

(12) United States Patent
Fukushima

(10) Patent No.: US 8,039,188 B2
(45) Date of Patent: Oct. 18, 2011

(54) ELECTROSTATIC IMAGE DEVELOPING TONER, ELECTROSTATIC IMAGE DEVELOPER, TONER CARTRIDGE, PROCESS CARTRIDGE AND IMAGE FORMING APPARATUS

(75) Inventor: Norihito Fukushima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 694 days.

(21) Appl. No.: 12/081,674

(22) Filed: Apr. 18, 2008

(65) Prior Publication Data

US 2009/0053638 A1 Feb. 26, 2009

(30) Foreign Application Priority Data

Aug. 22, 2007 (JP) ..... 2007-216247

(51) Int. Cl.
*G03G 9/087* (2006.01)

(52) U.S. Cl. ..... 430/109.5; 430/105

(58) Field of Classification Search ..... 430/105, 430/109.5
See application file for complete search history.

(56) References Cited

U.S. PATENT DOCUMENTS 5,464,718 A 11/1995 Kashizaki et al.
5,891,600 A * 4/1999 Okuno et al. ..... 430/45.1
2005/0196691 A1* 9/2005 Ohtani et al. ..... 430/105
2005/0255399 A1* 11/2005 Ichikawa et al. ..... 430/109.4

FOREIGN PATENT DOCUMENTS

CN 1129038 C 11/2003
JP A 2005-195782 7/2005
WO 2006/014019 * 2/2006

OTHER PUBLICATIONS

Feb. 28, 2011 Chinese Office Action issued in Chinese Patent Application No. 200810081860.7 (with translation).

* cited by examiner

*Primary Examiner* — Hoa Le
(74) *Attorney, Agent, or Firm* — Oliff & Berridge, PLC

(57) ABSTRACT

An electrostatic image developing toner including a binder resin; and a colorant, and satisfying following conditions (1) and (2):

$$0.02 \leqq C_A/C_B \leqq 0.20 \quad (1)$$

$$1 \leqq Nt/St \leqq 15 \quad (2)$$

wherein $C_A$ represents an amount of a carboxyl group and its salt on a surface of the toner, $C_B$ represents an amount of a carboxyl group and its salt in the entire toner, Nt represents an amount of a nitrogen element on the surface of the toner, and St represents an amount of a sulfur element on the surface of the toner.

18 Claims, No Drawings

ELECTROSTATIC IMAGE DEVELOPING TONER, ELECTROSTATIC IMAGE DEVELOPER, TONER CARTRIDGE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2007-216247 filed on Aug. 22, 2007.

BACKGROUND

1. Technical Field

The present invention relates to an electrostatic image developing toner, an electrostatic image developer, a toner cartridge, a process cartridge and an image forming apparatus.

2. Related Art

At present, a method of visualizing image information through an electrostatic image, such as electrophotographic process, is being utilized in various fields. In the electrophotographic process, an electrostatic image is formed on a photoreceptor through electrically charging and exposure steps, and the electrostatic latent image is developed with a developer containing a toner and then visualized through transfer and fixing steps. As for the developer used here, there are known a two-component developer comprising a toner and a carrier and a one-component developer using a magnetic toner or nonmagnetic toner alone.

On the other hand, the emulsion polymerization particle aggregating method is a production method of forming an aggregate particle in a size corresponding to the toner particle diameter, and then fusing and coalescing the aggregate particles by heating to produce a toner.

SUMMARY

According to an aspect of the invention, there is provided an electrostatic image developing toner including a binder resin; and a colorant, and satisfying following conditions (1) and (2):

$$0.02 \leqq C_A/C_B \leqq 0.20 \quad (1)$$

$$1 \leqq Nt/St \leqq 15 \quad (2)$$

wherein $C_A$ represents an amount of a carboxyl group and its salt on a surface of the toner, $C_B$ represents an amount of a carboxyl group and its salt in the entire toner, Nt represents an amount of a nitrogen element on the surface of the toner, and St represents an amount of a sulfur element on the surface of the toner.

DETAILED DESCRIPTION

The present invention is described in detail below.

(Electrostatic Image Developing Toner)

The electrostatic image developing toner (hereinafter sometimes simply referred to as a "toner") of the present invention includes a binder resin and a colorant and satisfies the following conditions (1) and (2):

(1) the ratio ($C_A/C_B$) between the amount ($C_A$) of a carboxyl group and its salt on the toner surface and the amount ($C_B$) of a carboxyl group and its salt in the entire toner is in the range of $0.02 \leqq C_A/C_B \leqq 0.20$; and (2) the ratio (Nt/St) between the amount (Nt) of a nitrogen element on the toner surface and the amount (St) of a sulfur element on the toner surface is in the range of $1 \leqq Nt/St \leqq 15$.

The electrostatic image developing toner of the present invention is excellent in the latent image reproducibility and aging stability. Also, the electrostatic image developing toner of the present invention can be suitably used as a positively charging toner.

In conventional techniques, electrical charging of a toner is greatly affected by a functional group on the surface, and an electron-withdrawing functional group is generally liable to be negatively charged.

The present inventors have found that a carboxyl group or a salt thereof tends to be negatively charged but when the amount thereof in the vicinity of the surface, which contributes to the electrical charging, is suppressed to a certain extent in comparison with the amount in the inside, that is, when the condition of (1) above is satisfied, the carboxy group or a salt thereof assists in maintaining the triboelectric charge with less regard to whether the triboelectric charge, instead of contributing to negative charging, is positive or negative. It is considered that when the triboelectric charge becomes more predominant than the electrostatic charge to which the carboxyl group itself contributes, the carboxyl group maintains the triboelectric charge by the polarization between carbon-oxygen bonds. Therefore, even a positive electrostatic charge can be maintained as compared with a case where a carboxyl group is not present.

Also, the nitrogen atom on the toner surface has a property of being positively charged and the sulfur atom has a property of reducing the change of triboelectric charge despite the environmental change of temperature, humidity or the like, so that when Nt/St is in the range of (2) above, a toner reduced in the environmental difference, particularly, a positively charging toner, can be obtained.

The toner of the present invention satisfies the condition (1) that the ratio ($C_A/C_B$) between the amount ($C_A$) of a carboxyl group and its salt on the toner surface and the amount ($C_B$) of a carboxyl group and its salt in the entire toner is in the range of $0.02 \leqq C_A/C_B \leqq 0.20$.

In the present invention, the amount ($C_A$) of a carboxyl group and its salt on the toner surface indicates the amount of a carboxyl group and its salt as measured by the potentiometric titration method described later. Also, the entire toner indicates the entirety of a toner particle and includes surface and inside portions of the toner. In the case of using an external additive in the toner, the entire toner includes the external additive in addition to the above-described portions.

In the toner of the present invention, the range in the condition (1) is preferably $0.02 \leqq C_A/C_B \leqq 0.10$, more preferably $0.03 \leqq C_A/C_B \leqq 0.07$.

In the present invention, the amount ($C_A$) of a carboxyl group and its salt on the toner surface is measured by the potentiometric titration method described below. That is, the potentiometric titration method described in JIS K0070 is used. The abundance of a salt is calculated from the difference between the measured values before and after acid washing of the toner surface.

In the present invention, the amount ($C_B$) of a carboxyl group and its salt in the entire toner is measured by the color change method described below. That is, the neutralization titration method described in JIS K0070 is used. As for the solvent, tetrahydrofuran is used.

In the toner of the present invention, the amount ($C_A$) of a carboxyl group and its salt on the toner surface is preferably from 0.5 to 3.0, more preferably from 1.0 to 2.0. Within this range, the environmental difference of the triboelectric charge becomes small.

Also, in the toner of the present invention, the amount ($C_B$) of a carboxyl group and its salt in the entire toner is preferably from 5.0 to 100, more preferably from 8.0 to 80. Within this range, abrupt growth of the particle size is not brought about during granulation of a toner.

The toner of the present invention satisfies the condition (2) that the ratio (Nt/St) between the amount (Nt) of a nitrogen element on the toner surface and the amount (St) of a sulfur element on the toner surface is in the range of $1 \leqq Nt/St \leqq 15$.

In the toner of the present invention, the range in the condition (2) is preferably $5 \leqq Nt/St \leqq 15$, more preferably $10 \leqq Nt/St \leqq 14$.

The amount (Nt) of a nitrogen element on the toner surface, the amount (St) of a sulfur element on the toner surface, and the ratio (Nt/St) therebetween are measured by the X-ray photoelectron spectroscopy (XPS) described below. That is, these amounts can be measured using a fluorescent X-ray analyzer (XRF-1500) manufactured by Shimadzu Corp. under measuring conditions of a tube voltage of 40 KV, a tube current of 90 mA and a measuring time of 30 minutes. Incidentally, Nt and St each is calculated in a unit of number of elements.

In the toner of the present invention, the amount (Nt) of a nitrogen element on the toner surface is preferably from 0.5 to 75, more preferably from 5.0 to 30.

Also, in the toner of the present invention, the amount (St) of a sulfur element on the toner surface is preferably from 0.5 to 5.0, more preferably from 0.7 to 2.0

The above-described ranges are preferred because the positive chargeability is stable.

The volume average particle diameter ($D_{50V}$) of the toner is preferably from 2 to 10 μm, more preferably from 3 to 8 μm, still more preferably from 5 to 7 μm.

The particle size distribution of the toner is preferably narrower. More specifically, the value ($GSD_p$) which is a square root of a ratio between the 16% diameter (abbreviated as $D_{16p}$) and the 84% diameter (abbreviated as $D_{84p}$) in terms of the number of toner particles accumulated from the smaller particle diameter side, that is, $GSD_p$ represented by the following formula, is preferably about 1.40 or less, more preferably about 1.31 or less, still more preferably from about 1.20 to about 1.27.

$$GSD_p=\{(D_{84p})/(D_{16p})\}^{0.5}$$

When the volume average particle diameter and $GSD_p$ both are in the above-described ranges, an extremely small particle is not present and therefore, reduction of developability due to excessive triboelectric charge of a small particle-size toner can be suppressed.

In the present invention, the particle diameter of the toner particle, the binder resin particle or the like can be measured by the following method.

In the case where the particle diameter to be measured in the present invention is 2 μm or more, suitable examples of the method for measuring the particle diameter of the toner or the like include a method in which by using a Coulter Multisizer Model II (manufactured by Beckman Coulter, Inc.) as the measuring apparatus and using ISOTON-II (produced by Beckman Coulter, Inc.) as the electrolytic solution, 10 mg of a measurement sample is added to a surfactant, preferably 2 ml of an aqueous 5% sodium alkylbenzenesulfonate solution, which works as the dispersant and after adding the resulting mixture to 100 ml of the electrolytic solution above, the particle diameter is measured.

In the case where the particle diameter to be measured in the present invention is less than 2 μm, examples of the method for measuring the particle diameter of the binder resin particle or the like include a method in which by using a laser diffraction particle size distribution measuring apparatus (LA-700, manufactured by Horiba, Ltd.), a sample in the state of a liquid dispersion is adjusted to about 2 g as the solid content, ion-exchanged water is added to make about 40 ml, the resulting dispersion is charged into a cell to an appropriate concentration, and after waiting for 2 minutes until the concentration in the cell becomes almost stable, the particle diameter is measured.

Incidentally, in the measurement of the volume average particle diameter, the obtained volume average particle diameters every channels are accumulated from the smaller volume average particle diameter side, and the value at an accumulation of 50% is defined as the volume average particle diameter.

In the case of measuring a powder material such as external additive, examples of the method include a method in which 2 g of a measurement sample is added to a surfactant, preferably 50 ml of an aqueous 5% sodium alkylbenzenesulfonate solution, and after dispersing the resulting mixture in an ultrasonic disperser (1,000 Hz) for 2 minutes to prepare a sample, the sample is measured in the same manner as the above-described liquid dispersion.

SF1 which is the shape factor of the toner is preferably from about 110 to about 145, more preferably from about 120 to about 140. The carrier generates electrostatic charge on contacting with the toner and within the range above, preferred contact between the toner and the carrier can be maintained. When SF1 is 110 or more, the contact point of the toner with the carrier has an appropriate area and this enables rapid increase in the triboelectric charge particularly of the toner newly added and relative decrease of the toner with low triboelectric charge, so that fogging can be suppressed. Also, when SF1 is 145 or less, the toner comes into point-contact with the carrier at an appropriate probability value and an excessive pressure is not applied to the contact portion of the toner with the carrier, as a result, the coat resin of the carrier can be prevented from being shaved by an external additive or the like contained in the toner and excellent triboelectric charge is obtained. Particularly, the tendency above is strong in a color image consuming a large amount of the toner, and SF1 of the toner is preferably in the above-described range.

The difference between the shape factor SF1 of the carrier and the shape factor SF1 of the toner is preferably from about 5 to about 20, more preferably from about 7 to about 18, still more preferably from about 10 to about 14.

In general, if the contact area between the carrier and the toner is small, the electrically charging rate is low, whereas if the contact area is large, not only the triboelectric charge can be hardly maintained but also the difference in the triboelectric charge is sometimes increased due to mutual electrostatic charge between the toner added and the electrically charged toner. This tendency is strong particularly in a positively charging toner, because the resin is originally liable to be negatively charged. For controlling the contact area between the carrier and the toner to a certain extent, the difference in SF1 is set to the above-described range, whereby the triboelectric charge can be maintained.

The shape factor SF1 of the toner or the carrier described later is a shape factor indicating the degree of unevenness on the particle surface and can be calculated by the following formula.

$$SF1 = \frac{(ML)^2}{A} \times \frac{\pi}{4} \times 100$$

In the formula, ML represents the maximum length of the particle, and A represents the projected area of the particle.

Specific examples of the method for measuring SF1 include a method in which an optical micrograph of the toner or carrier scattered on a slide glass is incorporated into an image analyzer through a video camera, the SF1 is calculated for 50 toner or carrier particles, and an average value thereof is determined.

<Binder Resin>

The toner of the present invention includes a binder resin.

The binder resin which can be used for the toner of the present invention include known addition polymerization-type resins and polycondensation resins.

Specific examples thereof include a polymer of an addition-polymerizable monomer such as styrenes (e.g., styrene, p-chlorostyrene, α-methylstyrene), (meth)acrylic acid esters (e.g., methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, 2-ethylhexyl methacrylate), ethylenically unsaturated nitriles (e.g., acrylonitrile, methacrylonitrile), vinyl ethers (e.g., vinyl methyl ether, vinyl isobutyl ether), vinyl ketones (e.g., vinyl methyl ketone, vinyl ethyl ketone, vinyl isopropenyl ketone), and polyolefins (e.g., ethylene, propylene, butadiene); a copolymer including a combination of two or more of these monomers; a mixture thereof; a non-vinyl condensed resin such as epoxy resin, polyester resin, polyurethane resin, polyamide resin, cellulose resin and polyether resin; a mixture thereof with the addition polymerization-type resin above; and a graft polymer obtained by polymerizing an addition-polymerizable monomer in the co-presence of the polymer above. One kind of these resins may be used alone, or two or more kinds thereof may be used in combination.

The binder resin which can be used in the present invention is preferably a resin containing a nitrogen-containing aromatic polymerizable monomer unit or a nitrogen-containing aliphatic polymerizable monomer unit, more preferably a resin containing a nitrogen-containing aromatic polymerizable monomer unit and a nitrogen-containing aliphatic polymerizable monomer unit.

Generally, in the case of polymerizing a resin, the polymerization rate of an aromatic polymerizable monomer having a high electron density is higher than that of an aliphatic polymerizable monomer. Therefore, in the copolymerization of an aromatic polymerizable monomer and an aliphatic polymerizable monomer, the aromatic polymerizable monomer is early polymerized and formed into a yarn ball shape along the formation of a resin. The electrical chargeability of the surface is important for imparting positive chargeability but in order to more stabilize it, the inside of the yarn ball needs to be also imparted with a property of being liable to be positively charged. For this reason, a resin containing a nitrogen-containing aromatic polymerizable monomer unit and a nitrogen-containing aliphatic polymerizable monomer unit is more preferred.

Incidentally, the aromatic polymerizable monomer indicates a monomer having an ethylenically unsaturated bond conjugated to an aromatic ring.

The nitrogen-containing aromatic polymerizable monomer is not particularly limited as long as it is a monomer containing an ethylenically unsaturated bond conjugated to an aromatic ring and a nitrogen atom, but is preferably a monomer containing an ethylenically unsaturated bond conjugated to an aromatic ring and at least one nitrogen-containing group selected from the group consisting of an unsubstituted, monosubstituted or disubstituted amino group, a nitro group, an unsubstituted, monosubstituted or disubstituted amide group, and a cyano group. Also, the nitrogen-containing aromatic polymerizable monomer is preferably a monomer where a nitrogen atom is bonded to an aromatic ring directly or through an unsaturated bond and/or a conjugating group such as carbonyl group.

Specific preferred examples of the nitrogen-containing aromatic polymerizable monomer include aminostyrene, nitrostyrene, cinnamamide and cinnamonitrile. Among these, p-nitrostyrene, cinnamamide and cinnamonitrile are more preferred.

The nitrogen-containing aliphatic polymerizable monomer is not particularly limited, but a monomer introducing the nitrogen atom into the side chain of a molecule constituting the resin is more preferred than a monomer introducing the nitrogen atom into the main chain, because the polymerizable monomer introducing the nitrogen atom into the side chain allows the nitrogen atom to be readily present on the toner surface when a toner particle is produced.

Also, the nitrogen-containing aliphatic polymerizable monomer is preferably a compound containing a nitrogen atom in the carbon chain of the alkoxy moiety of (meth) acrylic acid esters, more preferably a compound having an unsubstituted, monosubstituted or disubstituted amino group or a nitro group in the carbon chain of the alkoxy moiety of (meth)acrylic acid esters. Incidentally, the term "(meth) acryl" means acryl and methacryl, and the same applies hereinafter.

Specific preferred examples of the nitrogen-containing aliphatic polymerizable monomer include aminoalkyl (meth) acrylates such as aminomethyl (meth)acrylate, aminoethyl (meth)acrylate and aminopropyl (meth)acrylate, alkylaminoalkyl (meth)acrylates such as methylaminomethyl (meth) acrylate, methylaminoethyl (meth)acrylate and methylaminopropyl (meth)acrylate, dialkylaminoalkyl (meth)acrylates such as dimethylaminomethyl (meth)acrylate, dimethylaminoethyl (meth)acrylate, dimethylaminopropyl (meth)acrylate, diethylaminomethyl (meth)acrylate, diethylaminoethyl (meth)acrylate and diethylaminopropyl (meth)acrylate, and nitroalkyl (meth)acrylates such as nitromethyl (meth)acrylate, nitroethyl (meth)acrylate and nitropropyl (meth)acrylate. Among these, more preferred are aminoethyl (meth) acrylate, aminopropyl (meth)acrylate, methylaminoethyl (meth)acrylate, methylaminopropyl (meth)acrylate, dimethylaminoethyl (meth)acrylate, dimethylaminopropyl (meth)acrylate, diethylaminoethyl (meth)acrylate, diethylaminopropyl (meth)acrylate, nitroethyl (meth)acrylate and nitropropyl (meth)acrylate, and still more preferred are dimethylaminoethyl (meth)acrylate and diethylaminoethyl (meth)acrylate.

The toner of the present invention has a sulfur element at least on the surface portion. In the toner of the present invention, the sulfur element on the toner surface may be present in any state but is preferably present in the state of a mercapto group (—SH) or a thioether bond (—S—).

The sulfur element in the toner of the present invention is preferably a sulfur element derived from a sulfur-containing aliphatic compound used at the production of the binder resin.

The binder resin which can be used in the present invention is preferably produced using a sulfur-containing aliphatic compound.

The sulfur-containing aliphatic compound is used for controlling the polymerization degree at the polymerization and is generally used as a chain transfer agent.

The sulfur-containing aliphatic compound is not particularly limited as long as it is an aliphatic compound having a sulfur element, but a compound having a thiol component can be preferably used. From the standpoint that the change of electrical charging due to the temperature and humidity environment can be controlled, alkylmercaptans are more preferred, alkylmercaptans having a carbon number of 6 or more are still more preferred, and alkylmercaptans having a carbon number of 6 to 12 are yet still more preferred. Specific preferred examples thereof include hexylmercaptan, heptylmercaptan, octylmercaptan, nonylmercaptan, decylmercaptan and dodecylmercaptan.

The toner of the present invention has a carboxyl group and/or its salt on the surface and in the inside of the toner. The carboxyl group and/or its salt in the toner of the present invention are preferably a carboxyl group and/or its salt possessed by the binder resin.

The toner of the present invention preferably differs in the composition of resin components between the vicinity of the toner surface and the center portion of the toner. When the resin components in the vicinity of the toner surface and the resin components in the center portion of the toner are compared, the resin components in the center portion of the toner preferably contain a larger proportion of a carboxyl group and its salt than the resin components in the vicinity of the toner surface.

The binder resin having a carboxyl group and/or its salt may be a polycondensation resin having a carboxyl group or an addition polymerization-type resin having a carboxyl group but is preferably an addition polymerization-type resin obtained by using a monomer having a carboxyl group and an ethylenically unsaturated bond.

As for the monomer having a carboxyl group and an ethylenically unsaturated bond, a known monomer may be used, but specific preferred examples thereof include an acrylic acid, a methacrylic acid, a maleic acid, a cinnamic acid and a fumaric acid.

It is also preferred that the binder resin which can be used in the present invention is a resin containing a polymerizable monomer unit described below.

As for the polymerizable monomer, (meth)acrylic acid esters or unsaturated hydrocarbons can be preferably used. Specific preferred examples thereof include (meth)acrylic acid esters such as n-methyl (meth)acrylate, n-ethyl (meth) acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, tert-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, phenyl (meth) acrylate, biphenyl (meth)acrylate, diphenylethyl (meth)acrylate, tert-butylphenyl (meth)acrylate, terphenyl (meth)acrylate, cyclohexyl (meth)acrylate, tert-butylcyclohexyl (meth) acrylate, methoxyethyl (meth)acrylate, 2-hydroxyethyl (meth)acrylate, and β-carboxyethyl (meth)acrylate; and unsaturated hydrocarbons such as ethylene and propylene.

In the binder resin for use in the present invention, a crosslinking agent may also be added, if desired. A representative crosslinking agent is a polyfunctional monomer having two or more ethylenically unsaturated groups within the molecule.

Specific examples of the crosslinking agent include aromatic polyvinyl compounds such as divinylbenzene and divinylnaphthalene; polyvinyl esters of aromatic polyvalent carboxylic acid, such as divinyl phthalate, divinyl isophthalate, divinyl terephthalate, divinyl homophthalate, divinyl/trivinyl trimesate, divinyl naphthalenedicarboxylate and divinyl biphenylcarboxylate; divinyl esters of nitrogen-containing aromatic compound, such as divinyl pyridinedicarboxylate; vinyl esters of unsaturated heterocyclic compound, such as vinyl pyromucate, vinyl furancarboxylate, vinyl pyrrole-2-carboxylate and vinyl thiophenecarboxylate; (meth)acrylic acid esters of linear polyhydric alcohol, such as butanediol methacrylate, hexanediol acrylate, octanediol methacrylate, decanediol acrylate and dodecanediol methacrylate; (meth) acrylic acid esters of branched, substituted polyhydric alcohol, such as neopentyl glycol dimethacrylate and 2-hydroxy-1,3-diacryloxypropane; polyethylene glycol di(meth) acrylate and polypropylene polyethylene glycol di(meth) acrylates; and polyvinyl esters of polyvalent carboxylic acid, such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, dodecane diacid divinyl and divinyl brassylate.

In the present invention, one of these crosslinking agents may be used alone, or two or more thereof may be used in combination.

Among the above-described crosslinking agents, preferred as the crosslinking agent for use in the present invention are (meth)acrylic acid esters of linear polyhydric alcohol, such as butanediol methacrylate, hexanediol acrylate, octanediol methacrylate, decanediol acrylate and dodecanediol methacrylate; (meth)acrylic acid esters of branched, substituted polyhydric alcohol, such as neopentyl glycol dimethacrylate and 2-hydroxy-1,3-diacryloxypropane; polyethylene glycol di(meth)acrylate, and polypropylene polyethylene glycol di(meth)acrylates.

The content of the crosslinking agent is preferably from 0.05 to 5 wt %, more preferably from 0.1 to 1.0 wt %, based on the total amount of polymerizable monomers.

Out of the binder resins for use in the toner of the present invention, those capable of being produced by radical polymerization of a polymerizable monomer can be polymerized by using a radical polymerization initiator.

The radical polymerization initiator used here is not particularly limited, but a radical polymerization initiator allowing small change of pH in the reaction system during the reaction is preferred. The reason thereof is because the nitrogen-containing aliphatic polymerizable monomers in general all are not always strong against an acid and the functional group in the nitrogen moiety is sometimes destroyed due to change of pH, making it difficult to obtain a resin having preferred triboelectric charge.

Specific examples of the radical polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl perriphenylacetate hydroperoxide, tert-butyl performate, tert-butyl peracetate, tert-butyl perbenzoate, tert-butyl perphenylacetate, tert-butyl permethoxyacetate and tert-butyl per-N-(3-toluoyl)carbamate; azo compounds such as 2,2'-azobispropane, 2,2'-dichloro-2,2'-azobispropane, 1,1'-azo (methylethyl) diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate) and poly(tetraethylene glycol-2,2'-azobisisobutyrate); 1,4-bis(pentaethylene)-2-tetrazene; and 1,4-dimethoxycarbonyl-1,4-diphenyl-2-tetrazene.

The glass transition temperature of the binder resin which can be used in the present invention is preferably from about 50° C. to about 70° C., more preferably from about 50° C. to about 65° C., still more preferably from about 50° C. to about 60° C. This range is preferred because control of the internal structure and toner shape of the toner is facilitated.

The glass transition temperature of the binder resin which can be used in the present invention is determined by the DSC (differential scanning calorimeter) measuring method and can be obtained from a major maximum peak measured according to ASTM D3418-8.

The major maximum peak can be measured using DSC-7 manufactured by Perkin-Elmer, Inc., and examples of the method therefor include a method in which the temperature in the detection part of the apparatus above is corrected with the melting temperatures of indium and zinc, the heat quantity is corrected with the melting heat of indium, and using an aluminum pan while setting a blank pan for control, the sample is measured at a temperature rising rate of 10° C./min.

<Surfactant>

In the production of the toner of the present invention, a surfactant can be used for the purpose of, for example, stabilization at the dispersion in the suspension polymerization method, or dispersion and stabilization of the resin particle liquid dispersion, colorant liquid dispersion or releasing agent liquid dispersion in the emulsion polymerization aggregation method.

Examples of the surfactant include an anionic surfactant such as sulfate salt type, sulfonate salt type, phosphoric acid ester type and soap type; a cationic surfactant such as amine salt type and quaternary ammonium salt type; and a nonionic surfactant such as polyethylene glycol type, alkylphenol ethylene oxide adduct type and polyhydric alcohol type. Among these, an ionic surfactant is preferred, and an anionic surfactant and a cationic surfactant are more preferred.

In the toner of the present invention, an anionic surfactant is advantageously used as the surfactant for dispersing the releasing agent, because the anionic surfactant generally has a large dispersing power and ensures excellent dispersion of the resin particle and the colorant.

The nonionic surfactant is preferably used in combination with the anionic surfactant or cationic surfactant. One of the surfactants described above may be used alone, or two or more kinds thereof may be used in combination.

Specific examples of the anionic surfactant include fatty acid soaps such as potassium laurate, sodium oleate and sodium caster oil; sulfuric acid esters such as octyl sulfate, lauryl sulfate, lauryl ether sulfate and nonylphenyl ether sulfate; sodium alkylnaphthalene-sulfonates such as lauryl sulfonate, dodecylbenzene sulfonate, triisopropylnaphthalene sulfonate and dibutylnaphthalene sulfonate; sulfonates such as naphthalene sulfonate formalin condensate, monooctyl sulfosuccinate, dioctyl sulfosuccinate, lauric acid amide sulfonate and oleic acid amide sulfonate; phosphoric acid esters such as lauryl phosphate, isopropyl phosphate and nonylphenyl ether phosphate; dialkyl sulfosuccinates such as sodium dioctylsulfosuccinate; and sulfosuccinates such as disodium lauryl sulfosuccinate.

Specific examples of the cationic surfactant include amine salts such as laurylamine hydrochloride, stearylamine hydrochloride, oleylamine acetate, stearylamine acetate and stearylaminopropylamine acetate; and quaternary ammonium salts such as lauryltrimethylammonium chloride, dilauryldimethylammonium chloride, distearyldimethylammonium chloride, distearyldimethylammonium chloride, lauryldihydroxyethylmethylammonium chloride, oleylbispolyoxyethylenemethylammonium chloride, lauloylaminopropyldimethylethylammonium ethosulfate, lauroylaminopropyldimethylhydroxyethylammonium perchlorate, alkylbenzenetrimethylammonium chloride and alkyltrimethylammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkylphenyl ethers such as polyoxyethylene octylphenyl ether and polyoxyethylene nonylphenyl ether; alkyl esters such as polyoxyethylene laurate, polyoxyethylene stearate and polyoxyethylene oleate; alkylamines such as polyoxyethylene laurylamino ether, polyoxyethylene stearylamino ether, polyoxyethylene oleylamino ether, polyoxyethylene soybean amino ether and polyoxyethylene tallow amino ether; alkylamides such as polyoxyethylene lauric acid amide, polyoxyethylene stearic acid amide and polyoxyethylene oleic acid amide; vegetable oil ethers such as polyoxyethylene castor oil ether and polyoxyethylene rapeseed oil ether; alkanolamides such as lauric acid diethanolamide, stearic acid diethanolamide and oleic acid diethanolamide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The content of the surfactant in each liquid dispersion is sufficient if it is small enough not to impair the present invention, and is generally a small amount. Specifically, the surfactant content is from 0.01 to 3 wt %, more preferably from 0.05 to 2 wt %, still more preferably from 0.1 to 1 wt %. When the content is in this range, each liquid dispersion such as resin particle liquid dispersion, colorant liquid dispersion and releasing agent liquid dispersion is stable and causes no aggregation or isolation of a specific particle, the amount of the copper compound added is not affected, and the effect of the present invention can be sufficiently obtained. In general, the dispersion of suspension polymerization toner having a large particle diameter is stable even when the amount of the surfactant used is small.

<Electrostatic Charge Controlling Agent>

In the toner of the present invention, an electrostatic charge controlling agent may be added, if desired.

As for the electrostatic charge controlling agent, a known material may be used, but a halide of quaternary ammonium group-containing alkyl(phenyl) compound, or a polar group-containing resin-type electrostatic charge controlling agent can be used. In the case of producing the toner by a wet production process, a material hardly soluble in water is preferably used in view of control of ion intensity and reduction of waste water pollution. Incidentally, the toner of the present invention may be either a magnetic toner itself containing a magnetic material or a nonmagnetic toner containing no magnetic material.

<Aggregating Agent>

In the case of using an emulsion polymerization aggregation method for the production of the toner of the present invention, aggregation may be generated by changing the pH or the like in the aggregating step to prepare a particle having a toner particle diameter and containing a binder resin and a colorant. At the same time, an aggregating agent may be added so as to stably or quickly generate the aggregation of particles or to obtain an aggregate particle having a narrower particle size distribution.

The aggregating agent is preferably a compound having a monovalent or higher-valent electric charge, and specific examples of the compound include water-soluble surfactants such as ionic surfactant and nonionic surfactant described above; acids such as hydrochloric acid, sulfuric acid, nitric acid, acetic acid and oxalic acid; metal salts of inorganic acid, such as magnesium chloride, sodium chloride, aluminum sulfate, calcium sulfate, ammonium sulfate, aluminum nitrate, silver nitrate, copper sulfate and sodium carbonate; metal salts of aliphatic acid or aromatic acid, such as sodium acetate, potassium formate, sodium oxalate, sodium phthalate and potassium salicylate; and metal salts of phenols, such as sodium phenolate.

Considering the stability of aggregate particle and the stability of aggregating agent against heat and aging as well as its removal at washing, the aggregating agent is preferably a metal salt of inorganic acid in view of performance and usage. Specific examples thereof include metal salts of inorganic acid, such as magnesium chloride, sodium chloride, aluminum sulfate, calcium sulfate, ammonium sulfate, aluminum nitrate, silver nitrate, copper sulfate and sodium carbonate.

The amount of the aggregating agent added varies depending on the valence of electric charge but is small in any valence and is 3 wt % or less for a monovalent electric charge, 1 wt % or less for a divalent electric charge, and 0.5 wt % or less for a trivalent electric charge. The amount of the aggregating agent is preferably as small as possible and therefore, a compound having a higher valence is preferably used.

<Colorant>

The toner of the present invention contains a colorant.

The colorant which can be used in the present invention is not particularly limited, and a general dye or pigment can be used. However, some dyes are water-soluble and in the case of having a step of producing a toner in water as in the present invention, a pigment is preferred.

More specifically, examples of the yellow colorant include a monoazo-based pigment such as C.I. Pigment Yellow 74 and C.I. Pigment Yellow 1, 2, 3, 5, 6, 49, 65, 73, 75, 97, 98, 111, 116 and 130; a benzimidazolone-based pigment such as C.I. Pigment Yellow 154 and C.I. Pigment Yellow 120, 151, 175, 180, 181 and 194; a disazo condensation-based pigment such as C.I. Pigment Yellow 93 and C.I. Pigment Yellow 94, 95, 128 and 166; an isoindolinone-based pigment such as C.I. Pigment Yellow 110 and C.I. Pigment Yellow 109; an anthraquinone-based pigment such as C.I. Pigment Yellow 147 and C.I. Pigment Yellow 24, 108, 193 and 199; a disazo-based pigment such as C.I. Pigment Yellow 12, 13, 14, 17, 55, 63, 81, 83, 87, 90, 106, 113, 114, 121, 124, 126, 127, 136, 152, 170, 171, 172, 174, 176 and 188; an azo lake pigment such as C.I. Pigment Yellow 61, 62, 133, 168 and 169; an isoindolin-based pigment such as C.I. Pigment Yellow 139; and a quinophthalone-based pigment such as C.I. Pigment Yellow 138.

Examples of the magenta colorant include a β-naphthol-based pigment such as C.I. Pigment Red 146 and C.I. Pigment Red 2, 5, 7, 8, 9, 10, 11, 12, 13, 14, 15, 16, 17, 18, 21, 22, 23, 31, 32, 95, 112, 114, 119, 136, 147, 148, 150, 164, 170, 184, 187, 188, 210, 212, 213, 222, 223, 238, 245, 253, 256, 258, 261, 266, 267, 268 and 269; an azo lake-based pigment such as C.I. Pigment Red 57:1 and C.I. Pigment Red 18:1, 48:2, 48:3, 48:4, 48:5, 50:1, 51, 52:1, 52:2, 53:1, 53:2, 53:3, 58:2, 58:4, 64:1, 68 and 200; a quinacridone-based pigment such as C.I. Pigment Red 209, C.I. Pigment Red 122, 192, 202 and 207, and C.I. Pigment Violet 19; a disazo-based pigment such as C.I. Pigment Red 37, 38, 41 and 111, and C.I. Pigment Orange 13, 15, 16, 34 and 44; a benzimidazolone-based pigment such as C.I. Pigment Red 171, 175, 176, 185 and 208, C.I. Pigment Violet 32, and C.I. Pigment Orange 36, 60, 62 and 72; a disazo condensation-based pigment such as C.I. Pigment Red 144, 166, 214, 220, 221, 242, 248 and 262, and C.I. Pigment Orange 31; a dioxazine-based pigment such as C.I. Pigment Violet 23 and 37; and a diketopyrrolopyrrole-based pigment such as C.I. Pigment Red 254, 255, 264 and 272, and C.I. Pigment Orange 71 and 73.

Examples of the blue pigment include an organic colorant such as iron blue, cobalt blue, alkali blue lake, Victoria blue lake, fast sky blue, indanthrene blue BC, ultramarine blue, phthalocyanine blue and phthalocyanine green.

Examples of the black pigment include an organic colorant such as carbon black and aniline black.

Also, a green pigment such as chrome green, pigment green B, malachite green lake and final yellow green G, and a violet pigment such as manganese violet, fast violet B and methyl violet lake, may be used. As for the dye, various dyes such as basic, acidic, disperse and direct dyes may be used, and examples thereof include nigrosine, methylene blue, rose Bengal and quinoline yellow.

As for the dispersing method of the colorant, the colorant is dispersed in an aqueous medium together with a dispersant such as surfactant by applying a mechanical impact or the like to produce a colorant liquid dispersion, and the colorant liquid dispersion is aggregated together with the binder resin particle and like and granulated to the toner particle diameter, whereby the toner can be obtained.

Specific examples of the dispersing method of the colorant by a mechanical impact or the like include a media-type disperser such as rotation shearing homogenizer, ball mill, sand mill and attritor, and a high-pressure counter collision-type disperser. The liquid dispersion of the colorant particle can be prepared by using such a disperser. The colorant can also be dispersed in an aqueous medium by means of a homogenizer by using a surfactant having polarity.

In order to ensure the color formation at fixing, the colorant is preferably added in an amount of 4 to 15 wt %, more preferably from 4 to 10 wt %, based on the total weight of solid contents in the toner. However, in the case of using a magnetic material as a black colorant, the colorant is preferably added in an amount of 12 to 48 wt %, more preferably from 15 to 40 wt %. A toner of each color such as yellow toner, magenta toner, cyan toner, black toner, white toner or green toner can be obtained by appropriately selecting the kind of the colorant.

<Releasing Agent>

In the toner of the present invention, a releasing agent may be added, if desired. The releasing agent is generally used for enhancing the releasability, but for suppressing excessive electrostatic charge particularly in the winter environment, a releasing agent having a polar group is preferred. When a polar group is present, electrostatic charge in the winter environment can be suppressed by virtue of interaction with a water molecule. Specific examples of the releasing agent include low molecular weight polyolefins such as polyethylene, polypropylene and polybutene; silicones having a softening temperature under heating; fatty acid amides such as oleic acid amide, erucic acid amide, ricinoleic acid amide and stearic acid amide; vegetable waxes such as carnauba wax, rice wax, candelilla wax, haze wax and jojoba oil; animal waxes such as bees wax; mineral or petroleum waxes such as montan wax, ozokerite, ceresin, paraffin wax, microcrystalline wax and Fischer-Tropsch wax; and ester-based waxes such as fatty acid ester, montanic acid ester and carboxylic acid ester. Among these, vegetable waxes such as carnauba wax, rice wax, candelilla wax, haze wax and jojoba oil; animal waxes such as bees wax; and ester-based waxes such as fatty acid ester, montanic acid ester and carboxylic acid ester are preferred because of the above-described reason.

In the present invention, one of these releasing agents may be used alone, or two or more kinds thereof may be used in combination.

The amount of the releasing agent added is preferably from about 1 wt % to about 20 wt %, more preferably from about 5 wt % to about 15 wt %, based on the entire amount of toner particles. Within this range, sufficiently high effect of the releasing agent is obtained and the toner particle is not easily broken inside of the developing machine, as a result, the releasing agent is not spent to the carrier and the electrostatic charge is hardly lowered.

<Internal Additive>

In the toner of the present invention, an internal additive may be added to the inside of the toner.

The internal additive is generally used for the purpose of controlling viscoelasticity of the fixed image. Specific examples of the internal additive include an inorganic particle such as silica and titania, and an organic particle such as polymethyl methacrylate. The internal additive may be surface-treated for enhancing the dispersibility. One of these internal additives may be used alone, or two or more kinds thereof may be used in combination.

<External Additive>

In the toner of the present invention, an external additive such as fluidizing agent and electric charge controlling agent may be externally added.

As for the external additive, a known material may be used, and examples thereof include an inorganic particle surface-treated with a silane coupling agent or the like, such as silica particle, titanium oxide particle, alumina particle, cerium oxide particle and carbon black, a polymer particle such as polycarbonate, polymethyl methacrylate and silicone resin, an amine metal salt, and a salicylic acid metal complex. One of these external additives may be used alone, or two or more kinds thereof may be used in combination.

The external additive which can be used in the present invention is preferably an oxide containing a nitrogen atom, more preferably a silica particle containing a nitrogen atom. When the external additive is an oxide containing a nitrogen atom, the performance in terms of fogging at the change in the temperature and humidity environment, particularly at the change from a low-temperature low-humidity environment to a high-temperature high-humidity environment, and the image density are excellent.

Examples of the silica particle containing a nitrogen atom include a silica particle of which surface is treated with an aminosilane coupling agent.

(Production Method of Electrostatic Image Developing Toner)

The production method of the electrostatic image developing toner of the present invention is preferably an emulsion polymerization aggregation method. A specific functional group can be easily controlled to locate in a specific site and this facilitates bringing out the effect of the present invention.

The emulsion polymerization aggregation method preferably contains a step of mixing a resin particle liquid dispersion having dispersed therein a resin particle having a particle diameter of 1 μm or less, a colorant liquid dispersion having dispersed therein a colorant, and the like, thereby aggregating the resin particles and the colorant to the toner particle diameter (hereinafter sometimes referred to as an "aggregating step"). By virtue of this step, a specific functional group composed of nitrogen can be made to be present near the toner surface, and the above-described problems can be solved. Also, the emulsion polymerization aggregation method preferably contains a step of heating the aggregate particle obtained in the aggregating step at a temperature not less than the glass transition temperature of the resin particle, thereby fusing the aggregates to form a toner particle (hereinafter sometimes referred to as a "fusing step").

In the aggregating step, the particles in the resin particle liquid dispersion, the colorant liquid dispersion and, if desired, the releasing agent liquid dispersion liquid, which are mixed with each other, are aggregated to form an aggregate particle having the toner particle diameter. The aggregate particle is formed by hetero-aggregation or the like, and an ionic surfactant or a compound having a monovalent or higher-valent electric charge, such as metal salt, may be added for stabilizing the aggregate particle or controlling the particle size/particle size distribution.

The "toner particle diameter" as used herein means the volume average particle diameter of the toner described below.

In the fusing step, the resin particles in the aggregate particle are fused under the temperature condition of not less than the glass transition temperature of the resin particle, and the aggregate particle changes to a spherical shape from an irregular shape. At this time, the component derived from the nitrogen-containing aliphatic polymerizable monomer present in the vicinity of the aggregate particle surface readily comes to appear near the vicinity of the particle. The hydrophilicity of nitrogen itself may contribute to this, but a more major reason is because the polymerizable monomer remaining in the latter half of reaction exhibits low reactivity due to high polarity, causing a polar group stable to dispersion to be present outside of the particle, and since the surface area inside of the aggregate particle decreases along the progress of fusion, the hydrophilic group is further pushed out to the particle surface. Thereafter, the aggregate is separated from the aqueous medium and, if desired, subjected to washing and drying to form a toner particle.

(Electrostatic Image Developer)

The electrostatic image developing toner of the present invention can be used as an electrostatic image developer. The electrostatic image developer of the present invention is not particularly limited except for containing this electrostatic image developing toner and can take an appropriate composition of components according to the purpose. The electrostatic image developing toner when used alone is prepared as a one-component electrostatic image developer, and is prepared as a two-component electrostatic image developer when used in combination with a carrier.

The carrier is preferably a carrier obtained by using ferrite, iron powder or the like as the core material and coating it with a resin.

The core material (carrier core material) used is not particularly limited, and examples thereof include a magnetic metal such as iron, steel, nickel and cobalt, a magnetic oxide such as ferrite and magnetite, and glass bead. From the standpoint of using a magnetic brush method, a magnetic carrier is preferred. The average particle diameter of the carrier core material is preferably from 3 to 10 times the average particle diameter of the toner.

Also, the shape factor SF1 of the carrier is preferably from 110 to 145, more preferably from 120 to 140. Within this range, the carrier and the toner are contacted in an appropriate state, and the effect of triboelectric charge is more enhanced.

As for the resin which can be used as a coat resin or the like for the carrier, an acrylic resin, a styrene-based resin, a hydrocarbon-based resin, a silicone resin, or a copolymer resin thereof is preferably used. One of these resins which can be used for the carrier may be used alone, or two or more kinds thereof may be used in combination.

For the purpose of imparting positive chargeability to the toner, the carrier preferably contains a resin containing a fluorine atom and/or a silicon atom. By virtue of using a resin containing a fluorine atom and/or a silicon atom in the carrier, the carrier can be electrically charged more negatively over a long period of time. Also, the performance in terms of fogging at the change in the temperature and humidity environment, particularly at the change from a low-temperature low-humidity environment to a high-temperature high-humidity environment, and the image density are excellent.

The resin containing a fluorine atom and/or a silicon atom is preferably a resin obtained by replacing at least one hydrogen atom in an acrylic resin, a styrene-based resin, a hydrocarbon-based resin, or a copolymerization resin thereof by a fluorine atom, and/or a silicone resin, more preferably the resin with a hydrogen atom being replaced by a fluorine atom, which is obtained by polymerizing a polymerizable composition containing at least one polymerizable monomer having a fluorine atom, and/or a silicone resin, still more preferably a resin obtained by using at least a (meth)acrylic acid compound having a fluorine atom, and/or a silicone resin.

Specific examples of the polymerizable monomer having a fluorine atom include fluoromethyl (meth)acrylate, difluoromethyl (meth)acrylate, trifluoromethyl (meth)acrylate, trifluoromethylethyl (meth)acrylate, tetrafluoroethylmethyl (meth)acrylate, perfluoropropylethyl (meth)acrylate, perfluorobutylethyl (meth)acrylate, perfluorohexylethyl (meth) acrylate, perfluorooctylethyl (meth)acrylate, and perfluorooctylmethyl (meth)acrylate.

Also, for the purpose of controlling the electrostatic charge, a resin particle, an inorganic particle or the like may be dispersed in the coat resin.

Examples of the method for forming the resin coat layer on the surface of the carrier core material include a dipping method of dipping the carrier core material powder in a coat layer-forming solution, a spray method of spraying a coat layer-forming solution on the surface of the carrier core material, a fluid bed method of spraying a coat layer-forming solution on the carrier core material floated by fluidizing air, a kneader-coater method of mixing the carrier core material and a coat layer-forming solution in a kneader-coater and then removing the solvent, and a powder coating method of mixing the particulated coat resin with the carrier core material at a temperature not less than the melting temperature of the coat resin and then cooling the mixture to coat the resin. Among these, a kneader-coater method and a powder coating method are preferred.

The coverage of the resin formed by the method above is from 0.5 to 10 wt % based on the carrier core material. The mixing ratio (weight ratio) of the toner and the carrier is preferably toner/carrier=from 1/100 to 30/100, more preferably from 3/100 to 20/100.

(Image Forming Method)

The image forming method of the present invention includes a latent image forming step of forming an electrostatic latent image on the surface of a latent image carrier, a developing step of developing the electrostatic latent image formed on the surface of the latent image carrier with a toner-containing developer to form a toner image, a transfer step of transferring the toner image formed on the surface of the latent image carrier to the surface of a transferee element, and a fixing step of heat-fixing the toner image transferred to the surface of the transferee element.

The above-described steps each itself is a general step and described, for example, in JP-A-56-40868 and JP-A-49-91231.

Incidentally, the image forming method of the present invention may be performed by using a known image forming apparatus such as copying machine and facsimile machine.

The image forming method of the present invention may contain a step other than the above-described steps. Preferred examples thereof include a cleaning step of removing the electrostatic image developer remaining on the latent image carrier. In a preferred embodiment, the image forming method of the present invention further includes a recycling step. The recycling step is a step of returning the electrostatic image developing toner collected in the cleaning step to the developer layer. The image forming method including a recycling step of this embodiment can be implemented by using a toner recycling system-type image forming apparatus such as copying machine and facsimile machine. The image forming method of the present invention may also be applied to a recycling system where the cleaning step is omitted and the toner is collected simultaneously with the development.

As regards the latent image carrier, for example, an electrophotographic photoreceptor or a dielectric recording element can be used.

The electrical charging system is not particularly limited and either a known non-contact charging system using corotron or scorotron or a contact charging system may be used, but a contact charging system causing less generation of ozone is preferred.

The latent image forming step is a step of exposing the evenly charged surface of the latent image carrier by an exposing device such as laser optical system and LED array to form an electrostatic latent image. The exposing system is not particularly limited.

The developing step is a step of bringing the latent image carrier into contact with or into proximity to a developing roll having formed on the surface thereof a developer layer to attach toner particles to the electrostatic latent image and form a toner image on the electrophotographic photoreceptor.

The transfer step is a step of transferring the toner image onto a transferee element. Examples of the transferee element include a transfer paper sheet and an intermediate transfer drum or belt used for forming a color image.

The fixing step is a step of fixing the toner image transferred onto a transfer paper sheet or the like, on the fixing substrate such as paper by means of heating from a fixing member, where the toner image on the fixing substrate is heat-melt and thereby fixed while the fixing substrate such as paper is passed between two fixing members. The fixing members are in a roll or belt form, and at least one fixing member is equipped with a heating unit. As for the fixing member, a roll or a belt may be used as it is or may be used after coating its surface with a resin.

The fixing roll is produced by coating silicone rubber, Viton rubber or the like on the surface of a roll core material.

For the fixing belt, one of polyamide, polyimide, polyethylene terephthalate, polybutylene terephthalate and the like is used alone, or two or more kinds thereof are mixed and used. Examples of the coat resin for the roll or belt include a homopolymer of styrenes such as styrene, p-chlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acrylics such as dimethylaminoethyl methacrylate; vinyl nitriles such as acrylonitrile and methacrylonitrile, vinyl pyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; and fluorine-containing vinyl-based monomers such as vinylidene fluoride, tetrafluoroethylene and hexafluoropropylene; a copolymer including two or more kinds of these monomers; silicones such as methyl silicone and methylphenyl silicone; polyesters containing bisphenol, glycol or the like; an epoxy resin; a polyurethane resin; a polyamide resin; a cellulose resin; a polyether resin; and a polycarbonate resin. One of these resins may be used alone, or two or more kinds thereof may be used in combination. Specific examples thereof include polytetrafluoroethylene, a homopolymer and/or a copolymer of a fluorine-containing compound such as vinylidene fluoride and ethylene fluoride, and a homopolymer and/or a copolymer of an unsaturated hydrocarbon such as ethylene and propylene.

As for the transferee element on which the toner is fixed, a paper sheet, a resin film or the like is used. The fixing paper may be a coated paper sheet with the surface being partially or entirely coated by a resin. The resin film for fixing may also be a resin coated film with the surface being partially or entirely coated by another kind of a resin. Furthermore, a resin fine particle or an inorganic fine particle may be added to the transferee element for preventing duplicated feed of the transferee element due to friction of the paper, resin film or the like and/or static electricity or the like generated by the friction, and for preventing the releasing agent from dissolving out to the interface between the transferee element and the fixed image at the fixing and deteriorating the adhesion of the fixed image.

Specific examples of the coat resin for the paper and resin film include a homopolymer of styrenes such as styrene, p-chlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acrylics such as dimethylaminoethyl methacrylate; vinyl nitriles such as acrylonitrile and methacrylonitrile; vinyl pyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; and fluorine-containing vinyl-based monomers such as vinylidene fluoride, tetrafluoroethylene and hexafluoropropylene; a copolymer including two or more kinds of these monomers; silicones such as methyl silicone and methylphenyl silicone; polyesters containing bisphenol, glycol or the like; an epoxy resin; a polyurethane resin; a polyamide resin; a cellulose resin; a polyether resin; and a polycarbonate resin. One of these resins may be used alone, or two or more kinds thereof may be used in combination.

Specific examples of the inorganic particle include all particles usually used as an external additive for the toner surface, such as silica, titania, calcium carbonate, magnesium carbonate, tricalcium phosphate and cerium oxide. Examples of the resin particle include all particles usually used as an external additive for the toner surface, such as vinyl-based resin, polyester resin and silicone resin. Such an inorganic particle or resin particle may also be used as a fluidity aid.

(Image Forming Apparatus)

The image forming apparatus of the present invention includes a latent image carrier, an electrically charging device for electrically charging the latent image carrier, an exposure device for exposing the latent image carrier which is electrically charged, to form an electrostatic latent image on the latent image carrier, a developing device for developing the electrostatic latent image with a developer to form a toner image, and a transfer device for transferring the toner image onto a recording material from the latent image carrier, wherein the electrostatic image developing toner of the present invention or the electrostatic image developer of the present invention is used as the developer. Also, the image forming apparatus of the present invention further includes, if desired, a fixing device for fixing the toner image on a fixing substrate. In the transfer device, transfer may be performed twice or more by using an intermediate transfer element.

As for the latent image carrier and devices described above, the constructions described in respective steps of the image forming method can be preferably used.

Also, as for all of the devices described above, a device known in the image forming apparatus can be utilized. The image forming apparatus of the present invention may include a device, a unit and the like other that the above-described constructions. Furthermore, in the image forming apparatus of the present invention, a plurality of operations out of operations in those devices may be performed at the same time.

(Toner Cartridge)

The toner cartridge of the present invention is a toner cartridge housing therein at least the electrostatic image developing toner of the present invention or the electrostatic image developer of the present invention. The toner cartridge of the present invention can be suitably used in the image forming apparatus of the present invention. Also, the toner cartridge of the present invention can be more suitably used as a toner cartridge housing therein a toner or developer which is fed to the developing device provided in the image forming apparatus.

The toner or developer filled runs out before the photoreceptor (latent image carrier) deteriorates, and this offers various advantages to a user, for example, not only the image forming apparatus can be used in the state of always giving a stable image but also the operation of replenishing the toner or developer can be performed merely by removing and inserting the toner cartridge, neither requiring any cumbersome operation nor contaminating the hand, clothing or peripheral environment of the apparatus. The used toner cartridge can be recovered and reused after regulating or exchanging the constituent parts other than the toner or developer, if desired, and filling the toner or developer, and therefore, the recycle/reuse property is also excellent.

(Process Cartridge)

The process cartridge of the present invention is a process cartridge including a latent image carrier and at least one member selected from the group consisting of an electrically charging device for electrically charging the latent image carrier, a developing device for developing an electrostatic latent image formed on the latent image carrier with a developer to form a toner image, and a cleaning device for removing the toner remaining on the surface of the latent image carrier, wherein the electrostatic image developing toner of the present invention or the electrostatic image developer of the present invention is used as the developer.

The process cartridge of the present invention can be suitably used in the image forming apparatus of the present invention. Also, the process cartridge of the present invention can be more suitably used as a process cartridge being removably loaded in the image forming apparatus and housing therein a toner or developer which is fed to the developing device.

The process cartridge of the present invention is sufficient if it includes a latent image carrier and at least one member selected from a developing device, an electrically charging device, a transfer device and a cleaning device, and may include all of a latent image carrier, a developing device, an electrically charging device, a transfer device and a cleaning device.

The constituent elements in the process cartridge of the present invention are the same as those described above in regard to the image forming method of the present invention and the image forming apparatus of the present invention.

The toner or developer filled runs out before the photoreceptor (latent image carrier) deteriorates, and this offers various advantages to a user, for example, the image forming apparatus can be used in the state of always giving a stable image and at the same time, only the operation of removing and inserting the process cartridge is necessary but the operation of replenishing the toner, which is cumbersome and readily causes contamination of the hand, clothing or peripheral environment of the apparatus, can be dispensed with. The used process cartridge can be recovered and reused after repairing or exchanging the photoreceptor or regulating or exchanging other constituent parts, if desired, and filling the toner or developer, and therefore, the recycle/reuse property is also excellent.

In the case of including a cleaning device, it is also preferred to employ a construction where the cleaning device is a cleaning device of cleaning the surface of the latent image carrier after transfer by the transfer unit and collecting the toner or developer remaining on the surface of the latent image carrier and furthermore, a toner or developer returning device for conveying the collected toner or developer to the developing unit is provided.

EXEMPLARY EMBODIMENTS

The present invention is described in greater detail below by referring to Exemplary Embodiments, but the present invention is not limited thereto. In the following, unless otherwise indicated, the "parts" means "parts by weight".

<Preparation of Binder Resin Particle Liquid Dispersion (1)>

| | |
|---|---|
| Styrene | 77 parts |
| p-Nitrostyrene | 2 parts |
| n-Butyl acrylate | 6 parts |
| Dimethylaminoethyl acrylate | 15 parts |
| Acrylic acid | 0.1 parts |
| Dodecanethiol | 1 part |
| Divinyl adipate | 0.6 parts |

(All produced by Wako Pure Chemical Industries, Ltd.)

(All Produced by Wako Pure Chemical Industries, Ltd.)

A mixture obtained by mixing and dissolving the components above is added to a solution prepared by dissolving 0.5 parts of a nonionic surfactant (Nonipol 400, produced by Sanyo Chemical Industries, Ltd.) and 3 parts of an anionic surfactant (Neogen SC, produced by Dai-ichi Kogyo Seiyaku Co., Ltd.) in 150 parts of ion-exchanged water, and the resulting mixture is dispersed and emulsified in a flask. Furthermore, 28.2 Parts of ion-exchanged water having dissolved therein 5 parts of sodium persulfate (produced by Wako Pure Chemical Industries, Ltd.) is poured thereinto while slowly mixing the emulsion for 10 minutes, and nitrogen purging is performed at 0.1 liter/min for 20 minutes. Thereafter, the flask is heated in an oil bath while stirring inside of the flask until the temperature of the content becomes 70° C., and the emulsion polymerization is continued as it is for 5 hours to prepare Binder Resin Particle Liquid Dispersion (1) having a solid material concentration of 40%.

A part of the liquid dispersion is left standing on an oven at 100° C. to remove water and then measured by DSC (differential scanning calorimeter), as a result, the glass transition temperature is 54° C. and the weight average molecular weight is 34,000. At this time, Nt/St of the resin is 12.5.

<Preparation of Binder Resin Particle Liquid Dispersion (2)>

Binder Resin Particle Liquid Dispersion (2) is prepared in the same manner as in Preparation of Binder Resin Particle Liquid Dispersion (1) except for changing the amount of the anionic surfactant to 3.5 parts. The glass transition temperature is 53° C. and the weight average molecular weight is 34,000. At this time, Nt/St of the resin is 12.5.

<Preparation of Binder Resin Particle Liquid Dispersion (3)>

Binder Resin Particle Liquid Dispersion (3) is prepared in the same manner as in Preparation of Binder Resin Particle Liquid Dispersion (1) except for changing the amount of the acrylic acid to 0.05 parts and the amount of the anionic surfactant to 3.2 parts. The glass transition temperature is 54° C. and the weight average molecular weight is 34,000. At this time, Nt/St of the resin is 12.5.

<Preparation of Binder Resin Particle Liquid Dispersion (4)>

Binder Resin Particle Liquid Dispersion (4) is prepared in the same manner as in Preparation of Binder Resin Particle Liquid Dispersion (1) except for changing the amount of the acrylic acid to 0.2 parts. The glass transition temperature is 54° C. and the weight average molecular weight is 34,000. At this time, Nt/St of the resin is 12.5.

<Preparation of Binder Resin Particle Liquid Dispersion (5)>

Binder Resin Particle Liquid Dispersion (5) is prepared in the same manner as in Preparation of Binder Resin Particle Liquid Dispersion (1) except for changing the amount of the acrylic acid to 0.4 parts. The glass transition temperature is 55° C. and the weight average molecular weight is 34,000. At this time, Nt/St of the resin is 12.5.

<Preparation of Binder Resin Particle Liquid Dispersion (6)>

Binder Resin Particle Liquid Dispersion (6) is prepared in the same manner as in Preparation of Binder Resin Particle Liquid Dispersion (1) except for changing the amount of the acrylic acid to 0.45 parts. The glass transition temperature is 55° C. and the weight average molecular weight is 34,000. At this time, Nt/St of the resin is 12.5.

<Preparation of Binder Resin Particle Liquid Dispersion (7)>

Binder Resin Particle Liquid Dispersion (7) is prepared in the same manner as in Preparation of Binder Resin Particle Liquid Dispersion (1) except for changing the construction of Binder Resin Particle Liquid Dispersion (1) to the following construction and the amount of sodium persulfate to 2 parts.

| | |
|---|---|
| Styrene | 79.5 parts |
| p-Nitrostyrene | 0.5 parts |
| n-Butyl acrylate | 19 parts |
| Dimethylaminoethyl acrylate | 1 part |
| Acrylic acid | 0.1 parts |
| Dodecanethiol | 2.2 parts |
| Divinyl adipate | 0.8 parts |

The glass transition temperature is 51° C. and the weight average molecular weight is 28,000. At this time, Nt/St of the resin is 0.5.

<Preparation of Binder Resin Particle Liquid Dispersion (8)>

Binder Resin Particle Liquid Dispersion (8) is prepared in the same manner as in Preparation of Binder Resin Particle Liquid Dispersion (1) except for changing the construction of Binder Resin Particle Liquid Dispersion (1) to the following construction and the amount of sodium persulfate to 3 parts.

| | |
|---|---|
| Styrene | 79.5 parts |
| p-Nitrostyrene | 0.5 parts |
| n-Butyl acrylate | 18 parts |
| Dimethylaminoethyl acrylate | 2 parts |
| Acrylic acid | 0.1 parts |
| Dodecanethiol | 1.5 parts |
| Divinyl adipate | 0.8 parts |

The glass transition temperature is 52° C. and the weight average molecular weight is 33,000. At this time, Nt/St of the resin is 1.2.

<Preparation of Binder Resin Particle Liquid Dispersion (9)>

Binder Resin Particle Liquid Dispersion (9) is prepared in the same manner as in Preparation of Binder Resin Particle Liquid Dispersion (1) except for changing the construction of Binder Resin Particle Liquid Dispersion (1) to the following construction.

| | |
|---|---|
| Styrene | 78 parts |
| p-Nitrostyrene | 2 parts |
| n-Butyl acrylate | 9.5 parts |
| Dimethylaminoethyl acrylate | 10.5 parts |
| Acrylic acid | 0.1 parts |
| Dodecanethiol | 1 part |
| Divinyl adipate | 0.6 parts |

The glass transition temperature is 54° C. and the weight average molecular weight is 31,000. At this time, Nt/St of the resin is 9.1.

<Preparation of Binder Resin Particle Liquid Dispersion (10)>

Binder Resin Particle Liquid Dispersion (10) is prepared in the same manner as in Preparation of Binder Resin Particle Liquid Dispersion (1) except for changing the construction of Binder Resin Particle Liquid Dispersion (1) to the following construction and the amount of sodium persulfate to 7 parts.

| | |
|---|---|
| Styrene | 78 parts |
| p-Nitrostyrene | 2 parts |
| n-Butyl acrylate | 10 parts |
| Dimethylaminoethyl acrylate | 10 parts |
| Acrylic acid | 0.1 parts |
| Dodecanethiol | 0.6 parts |
| Divinyl adipate | 0.4 parts |

The glass transition temperature is 54° C. and the weight average molecular weight is 36,000. At this time, Nt/St of the resin is 14.6.

<Preparation of Binder Resin Particle Liquid Dispersion (11)>

Binder Resin Particle Liquid Dispersion (11) is prepared in the same manner as in Preparation of Binder Resin Particle Liquid Dispersion (1) except for changing the construction of Binder Resin Particle Liquid Dispersion (1) to the following construction and the amount of sodium persulfate to 8 parts.

| | |
|---|---|
| Styrene | 78.4 parts |
| p-Nitrostyrene | 1.6 parts |
| n-Butyl acrylate | 10 parts |
| Dimethylaminoethyl acrylate | 10 parts |
| Acrylic acid | 0.1 parts |
| Dodecanethiol | 0.5 parts |
| Divinyl adipate | 0.3 parts |

The glass transition temperature is 54° C. and the weight average molecular weight is 40,000. At this time, Nt/St of the resin is 17.0.

<Preparation of Binder Resin Particle Liquid Dispersion (12)>

Binder Resin Particle Liquid Dispersion (12) is prepared in the same manner as in Preparation of Binder Resin Particle Liquid Dispersion (1) except for changing the construction of Binder Resin Particle Liquid Dispersion (1) to the following construction.

| | |
|---|---|
| Styrene | 78 parts |
| p-Nitrostyrene | 2 parts |
| n-Butyl acrylate | 5 parts |
| Dimethylaminoethyl acrylate | 15 parts |
| Acrylic acid | 3 parts |
| Dodecanethiol | 1 part |
| Divinyl adipate | 0.6 parts |

The glass transition temperature is 54° C. and the weight average molecular weight is 32,000. At this time, Nt/St of the resin is 12.5.

<Preparation of Binder Resin Particle Liquid Dispersion (13)>

Binder Resin Particle Liquid Dispersion (13) is prepared in the same manner as in Preparation of Binder Resin Particle Liquid Dispersion (1) except for changing the construction of Binder Resin Particle Liquid Dispersion (1) to the following construction.

| | |
|---|---|
| Styrene | 60 parts |
| p-Nitrostyrene | 20 parts |
| n-Butyl acrylate | 20 parts |
| Acrylic acid | 0.1 parts |
| Dodecanethiol | 1.2 parts |
| Divinyl adipate | 0.7 parts |

The glass transition temperature is 53° C. and the weight average molecular weight is 30,000. At this time, Nt/St of the resin is 11.5.

<Preparation of Binder Resin Particle Liquid Dispersion (14)>

Binder Resin Particle Liquid Dispersion (14) is prepared in the same manner as in Preparation of Binder Resin Particle Liquid Dispersion (1) except for changing the construction of Binder Resin Particle Liquid Dispersion (1) to the following construction.

| | |
|---|---|
| Styrene | 80 parts |
| n-Butyl acrylate | 5 parts |
| Dimethylaminoethyl acrylate | 15 parts |
| Acrylic acid | 0.1 parts |
| Dodecanethiol | 0.6 parts |
| Divinyl adipate | 0.5 parts |

The glass transition temperature is 54° C. and the weight average molecular weight is 33,000. At this time, Nt/St of the resin is 11.1.

<Preparation of Binder Resin Particle Liquid Dispersion (15)>

Binder Resin Particle Liquid Dispersion (15) is prepared in the same manner as in Preparation of Binder Resin Particle Liquid Dispersion (1) except for changing p-nitrostyrene of Binder Resin Particle Liquid Dispersion (1) to cinnamamide (produced by Wako Pure Chemical Industries, Ltd.) and the mounts of dimethylaminoethyl acrylate and n-butyl acrylate to 8 parts and 12 parts, respectively. The glass transition temperature is 53° C. and the weight average molecular weight is 31,000. At this time, Nt/St of the resin is 10.3.

<Preparation of Binder Resin Particle Liquid Dispersion (16)>

Binder Resin Particle Liquid Dispersion (16) is prepared in the same manner as in Preparation of Binder Resin Particle Liquid Dispersion (15) except for changing cinnamamide of Binder Resin Particle Liquid Dispersion (15) to cinnamonitrile (produced by Wako Pure Chemical Industries, Ltd.). The glass transition temperature is 53° C. and the weight average molecular weight is 30,000. At this time, Nt/St of the resin is 10.5.

<Preparation of Colorant Liquid Dispersion (Y)>

| | |
|---|---|
| C.I. Pigment Yellow 74 (monoazo-based pigment) (Seika Fast Yellow 2054, produced by Dainichiseika Color and Chemicals Mfg. Co., Ltd.) | 100 parts |
| Anionic surfactant (Neogen RK, produced by Dai-ichi Kogyo Seiyaku Co., Ltd.) | 10 parts |
| Ion-exchanged water | 490 parts |

These components are mixed and dissolved, and the resulting mixture is dispersed in a homogenizer (Ultra-Turrax, manufactured by IKA Works, Inc.) for 10 minutes to prepare Colorant Liquid Dispersion (Y).

<Preparation of Colorant Liquid Dispersion (M)>

Colorant Liquid Dispersion (M) is prepared in the same manner as Colorant Liquid Dispersion (Y) except for changing the colorant to C.I. Pigment Red 122 (quinacridone-based pigment, Chromofine Magenta 6887, produced by Dainichiseika Color and Chemicals Mfg. Co., Ltd.).

<Preparation of Colorant Liquid Dispersion (C)>

Colorant Liquid Dispersion (C) is prepared in the same manner as Colorant Liquid Dispersion (Y) except for changing the colorant to C.I. Pigment Blue 15:3 (phthalocyanine-based pigment, Cyanine Blue 4937, produced by Dainichiseika Color and Chemicals Mfg. Co., Ltd.).

<Preparation of Colorant Liquid Dispersion (K)>

Colorant Liquid Dispersion (K) is prepared in the same manner as Colorant Liquid Dispersion (Y) except for changing the colorant to carbon black (Regal 330, produced by Cabot Inc.).

<Preparation of Releasing Agent Particle Liquid Dispersion>

| | |
|---|---|
| Paraffin wax (HNP-9, produced by Nippon Seiro Co., Ltd.) | 100 parts |
| Anionic surfactant (Lipal 860K, produced by Lion Corp.) | 10 parts |
| Ion-exchanged water | 390 parts |

These components are mixed and dissolved, and the resulting mixture is dispersed in a homogenizer (Ultra-Turrax, manufactured by IKA Works, Inc.) and then subjected to a dispersion treatment in a pressure jet-type homogenizer (130° C., 350 kg/cm$^2$) to prepare a releasing agent particle liquid dispersion having dispersed therein a releasing agent particle (paraffin wax).

(Production of Toner 1)

| | |
|---|---|
| Binder Resin Particle Liquid Dispersion (12) | 280 parts |
| Colorant Liquid Dispersion (C) | 80 parts |
| Releasing agent particle liquid dispersion | 96 parts |
| Aluminum sulfate (produced by Wako Pure Chemical Industries, Ltd.) | 1.5 parts |
| Ion-exchanged water | 1,270 parts |

These components are housed in a round-bottom stainless steel-made flask with a temperature controlling jacket and dispersed by a homogenizer (Ultra-Turrax T50, manufactured by IKA Works, Inc.) at 5,000 rpm for 5 minutes, and the resulting dispersion is transferred to a flask, left standing at 25° C. for 20 minutes with stirring by a four-blade paddle, then heated by a mantle heater with stirring at a temperature rising rate of 1° C./min until the temperature in the inside reaches 48° C., and kept at 48° C. for 20 minutes. Subsequently, 120 parts of Binder Resin Particle Liquid Dispersion (1) is gradually charged thereinto and after keeping at 48° C. for 30 minutes, the pH is adjusted to 6.5 by adding an aqueous 1N sodium hydroxide solution.

Thereafter, the temperature of the resulting solution is elevated at a temperature rising rate of 1° C./min to 98° C. and kept for 30 minutes, and the pH is adjusted to 4.8 by adding an aqueous 0.1N nitric acid solution. After standing at 98° C. for 2 hours, the pH is further adjusted to 5.2 by adding the aqueous 1N sodium hydroxide solution above, and the obtained solution is left standing at 98° C. for 8 hours and then cooled to 30° C. at 5° C./min.

The finished toner particle liquid dispersion is filtered, (A) 2,000 parts of ion-exchanged water at 35° C. is added to the obtained toner particle, and (B) the mixture is left standing for 20 minutes and (C) then filtered. After repeating the operations (A) to (C) 5 times, the toner particle on the filter paper is transferred to a vacuum dryer and dried at 45° C. and 1,000 Pa or less for 10 hours. The pressure is set to 1,000 Pa or less because the toner particle above is in a hydrated state and the water freezes even at 45° C. in the initial stage of drying and thereafter sublimates to make inconstant the internal pressure of the dryer at the pressure reduction. However, the pressure is stabilized at 100 Pa when the drying is completed. After returning the inside of the dryer to atmospheric pressure, the toner particle is taken out to obtain a toner mother particle, and 1.5 parts of the following Silica External Additive A is added to 100 parts of the toner mother particle and mixed in a Henschel mixer at 3,000 rpm for 3 minutes to obtain Toner 1.

| | |
|---|---|
| Silica external additive (A-200, produced by Nippon Aerosil Co., Ltd.) | 100 parts |
| Aminosilane coupling agent (SZ-6023, produced by Dow Corning Toray Co., Ltd.) | 6 parts |

These are added to 100 parts of toluene and heated to perform a coupling treatment. Thereafter, toluene is removed by distillation and after drying, 6 parts of dimethylsilicone oil (L-45, produced by Nippon Unicar Co., Ltd.) is added. The mixture is stirred and cracked to obtain Silica External Additive A.

Toner 1 obtained has $D_{50V}$ of 5.8 μm, $GSD_V$ of 1.22, a glass transition temperature of 53° C., and a shape factor SF1 of 119. Also, the ratio of the amounts of a carboxyl group and its salt between the toner surface and the entire toner is 0.04, and Nt/St is 12.5.

(Production of Toner 2)

A toner is produced in the same manner as Toner 1 except that in Production of Toner 1, pH adjusted to 5.2 and standing at 98° C. for 8 hours are changed to pH adjusted to 5.8 and standing at a temperature of 98° C. for 5 hours.

Toner 2 obtained has $D_{50V}$ of 5.8 μm. $GSD_V$ of 1.22, a glass transition temperature of 53° C., and a shape factor SF1 of 124. Also, the ratio of the amounts of a carboxyl group and its salt between the toner surface and the entire toner is 0.04, and Nt/St is 12.5.

(Production of Toner 3)

A toner is produced in the same manner as Toner 1 except that in Production of Toner 1, 98° C. is changed to 96° C. and pH adjusted to 5.2 and standing at 98° C. for 8 hours are changed to pH adjusted to 5.8 and standing at a temperature of 96° C. for 4 hours.

Toner 3 obtained has $D_{50V}$ of 5.8 μm, $GSD_V$ of 1.22, a glass transition temperature of 53° C., and a shape factor SF1 of 128. Also, the ratio of the amounts of a carboxyl group and its salt between the toner surface and the entire toner is 0.04, and Nt/St is 12.5.

(Production of Toner 4)

A toner is produced in the same manner as Toner 3 except that in Production of Toner 3, 96° C. is changed to 95° C.

Toner 4 obtained has $D_{50V}$ of 5.8 μm, $GSD_V$ of 1.22, a glass transition temperature of 53° C., and a shape factor SF1 of 133. Also, the ratio of the amounts of a carboxyl group and its salt between the toner surface and the entire toner is 0.04, and Nt/St is 12.5.

(Production of Toner 5)

A toner is produced in the same manner as Toner 4 except for changing Colorant Liquid Dispersion (C) to Colorant Liquid Dispersion (M).

Toner 5 obtained has $D_{50V}$ of 5.8 μm, $GSD_V$ of 1.22, a glass transition temperature of 53° C., and a shape factor SF1 of 133. Also, the ratio of the amounts of a carboxyl group and its salt between the toner surface and the entire toner is 0.04, and Nt/St is 12.5.

(Production of Toner 6)

A toner is produced in the same manner as Toner 4 except for changing Colorant Liquid Dispersion (C) to Colorant Liquid Dispersion (Y).

Toner 6 obtained has $D_{50V}$ of 5.9 μm, $GSD_V$ of 1.22, a glass transition temperature of 53° C., and a shape factor SF1 of 134. Also, the ratio of the amounts of a carboxyl group and its salt between the toner surface and the entire toner is 0.04, and Nt/St is 12.5.

(Production of Toner 7)

A toner is produced in the same manner as Toner 4 except for changing Colorant Liquid Dispersion (C) to Colorant Liquid Dispersion (K).

Toner 7 obtained has $D_{50V}$ of 5.8 μm, $GSD_V$ of 1.22, a glass transition temperature of 53° C., and a shape factor SF1 of 131. Also, the ratio of the amounts of a carboxyl group and its salt between the toner surface and the entire toner is 0.04, and Nt/St is 12.5.

(Production of Toner 8)

A toner is produced in the same manner as Toner 4 except that in Production of Toner 4, pH adjusted to 5.8 and standing at a temperature of 95° C. for 4 hours are changed to pH adjusted to 6.0 and standing at 95° C. for 3 hours.

Toner 8 obtained has $D_{50V}$ of 5.9 μm, $GSD_V$ of 1.23, a glass transition temperature of 53° C., and a shape factor SF1 of 139. Also, the ratio of the amounts of a carboxyl group and its salt between the toner surface and the entire toner is 0.04, and Nt/St is 12.5.

(Production of Toner 9)

A toner is produced in the same manner as Toner 4 except that in Production of Toner 4, pH adjusted to 5.8 and standing at a temperature of 95° C. for 4 hours are changed to pH adjusted to 6.4 and standing at 95° C. for 2.5 hours.

Toner 9 obtained has $D_{50V}$ of 5.9 μm, $GSD_V$ of 1.23, a glass transition temperature of 53° C., and a shape factor SF1 of 143. Also, the ratio of the amounts of a carboxyl group and its salt between the toner surface and the entire toner is 0.04, and Nt/St is 12.5.

(Production of Toner 10)

A toner is produced in the same manner as Toner 4 except that in Production of Toner 4, Binder Resin Particle Liquid Dispersion (1) is changed to Binder Resin Particle Liquid Dispersion (2).

Toner 10 obtained has $D_{50V}$ of 5.8 μm, $GSD_V$ of 1.22, a glass transition temperature of 53° C., and a shape factor SF1 of 133. The amount of a carboxyl group on the toner surface is below the detection limit and the ratio of the amounts of a carboxyl group and its salt cannot be measured. Nt/St is 12.5.

(Production of Toner 11)

A toner is produced in the same manner as Toner 4 except that in Production of Toner 4, Binder Resin Particle Liquid Dispersion (1) is changed to Binder Resin Particle Liquid Dispersion (3).

Toner 11 obtained has $D_{50V}$ of 5.8 μm, $GSD_V$ of 1.22, a glass transition temperature of 53° C., and a shape factor SF1 of 133. Also, the ratio of the amounts of a carboxyl group and its salt between the toner surface and the entire toner is 0.024, and Nt/St is 12.5.

(Production of Toner 12)

A toner is produced in the same manner as Toner 4 except that in Production of Toner 4, Binder Resin Particle Liquid Dispersion (1) is changed to Binder Resin Particle Liquid Dispersion (4).

Toner 12 obtained has $D_{50V}$ of 5.9 μm, $GSD_V$ of 1.23, a glass transition temperature of 54° C., and a shape factor SF1 of 134. Also, the ratio of the amounts of a carboxyl group and its salt between the toner surface and the entire toner is 0.093, and Nt/St is 12.5.

(Production of Toner 13)

A toner is produced in the same manner as Toner 4 except that in Production of Toner 4, Binder Resin Particle Liquid Dispersion (1) is changed to Binder Resin Particle Liquid Dispersion (5).

Toner 13 obtained has $D_{50V}$ of 5.9 μm, $GSD_V$ of 1.24, a glass transition temperature of 54° C., and a shape factor SF1 of 134. Also, the ratio of the amounts of a carboxyl group and its salt between the toner surface and the entire toner is 0.18, and Nt/St is 12.5.

(Production of Toner 14)

A toner is produced in the same manner as Toner 4 except that in Production of Toner 4, Binder Resin Particle Liquid Dispersion (1) is changed to Binder Resin Particle Liquid Dispersion (6).

Toner 14 obtained has $D_{50V}$ of 5.9 μm, $GSD_V$ of 1.24, a glass transition temperature of 54° C., and a shape factor SF1 of 134. Also, the ratio of the amounts of a carboxyl group and its salt between the toner surface and the entire toner is 0.21, and Nt/St is 12.5.

(Production of Toner 15)

A toner is produced in the same manner as Toner 4 except that in Production of Toner 4, Binder Resin Particle Liquid Dispersion (1) is changed to Binder Resin Particle Liquid Dispersion (7).

Toner 15 obtained has $D_{50V}$ of 5.8 μm, $GSD_V$ of 1.23, a glass transition temperature of 53° C., and a shape factor SF1 of 131. Also, the ratio of the amounts of a carboxyl group and its salt between the toner surface and the entire toner is 0.04, and Nt/St is 0.5.

(Production of Toner 16)

A toner is produced in the same manner as Toner 4 except that in Production of Toner 4, Binder Resin Particle Liquid Dispersion (1) is changed to Binder Resin Particle Liquid Dispersion (8).

Toner 16 obtained has $D_{50V}$ of 5.8 μm, $GSD_V$ of 1.23, a glass transition temperature of 53° C., and a shape factor SF1 of 131. Also, the ratio of the amounts of a carboxyl group and its salt between the toner surface and the entire toner is 0.04, and Nt/St is 1.2.

(Production of Toner 17)

A toner is produced in the same manner as Toner 4 except that in Production of Toner 4, Binder Resin Particle Liquid Dispersion (1) is changed to Binder Resin Particle Liquid Dispersion (9).

Toner 17 obtained has $D_{50V}$ of 5.8 μm, $GSD_V$ of 1.23, a glass transition temperature of 53° C., and a shape factor SF1 of 131. Also, the ratio of the amounts of a carboxyl group and its salt between the toner surface and the entire toner is 0.04, and Nt/St is 9.1.

(Production of Toner 18)

A toner is produced in the same manner as Toner 4 except that in Production of Toner 4, Binder Resin Particle Liquid Dispersion (1) is changed to Binder Resin Particle Liquid Dispersion (10).

Toner 18 obtained has $D_{50V}$ of 5.8 μm, $GSD_V$ of 1.23, a glass transition temperature of 53° C., and a shape factor SF1 of 131. Also, the ratio of the amounts of a carboxyl group and its salt between the toner surface and the entire toner is 0.04, and Nt/St is 14.6.

(Production of Toner 19)

A toner is produced in the same manner as Toner 4 except that in Production of Toner 4, Binder Resin Particle Liquid Dispersion (1) is changed to Binder Resin Particle Liquid Dispersion (11).

Toner 19 obtained has $D_{50V}$ of 5.8 μm, $GSD_V$ of 1.23, a glass transition temperature of 53° C., and a shape factor SF1 of 131. Also, the ratio of the amounts of a carboxyl group and its salt between the toner surface and the entire toner is 0.04, and Nt/St is 17.0.

(Production of Toner 20)

A toner is produced in the same manner as Toner 4 except that in Production of Toner 4, Binder Resin Particle Liquid Dispersion (1) is changed to Binder Resin Particle Liquid Dispersion (13).

Toner 20 obtained has $D_{50V}$ of 5.8 μm, $GSD_V$ of 1.23, a glass transition temperature of 56° C., and a shape factor SF1 of 135. Also, the ratio of the amounts of a carboxyl group and its salt between the toner surface and the entire toner is 0.04, and Nt/St is 11.5.

(Production of Toner 21)

A toner is produced in the same manner as Toner 4 except that in Production of Toner 4, Binder Resin Particle Liquid Dispersion (1) is changed to Binder Resin Particle Liquid Dispersion (14).

Toner 21 obtained has $D_{50V}$ of 5.8 μm, $GSD_V$ of 1.23, a glass transition temperature of 52° C., and a shape factor SF1 of 130. Also, the ratio of the amounts of a carboxyl group and its salt between the toner surface and the entire toner is 0.04, and Nt/St is 11.1.

(Production of Toner 22)

A toner is produced in the same manner as Toner 4 except that in Production of Toner 4, Binder Resin Particle Liquid Dispersion (1) is changed to Binder Resin Particle Liquid Dispersion (15).

Toner 22 obtained has $D_{50V}$ of 5.8 μm, $GSD_V$ of 1.23, a glass transition temperature of 53° C., and a shape factor SF1 of 134. Also, the ratio of the amounts of a carboxyl group and its salt between the toner surface and the entire toner is 0.04, and Nt/St is 10.3.

(Production of Toner 23)

A toner is produced in the same manner as Toner 4 except that in Production of Toner 4, Binder Resin Particle Liquid Dispersion (1) is changed to Binder Resin Particle Liquid Dispersion (16).

Toner 23 obtained has $D_{50V}$ of 5.8 μm, $GSD_V$ of 1.23, a glass transition temperature of 53° C., and a shape factor SF1 of 134. Also, the ratio of the amounts of a carboxyl group and its salt between the toner surface and the entire toner is 0.04, and Nt/St is 10.5.

(Production of Toner 24)

Toner 24 is produced in the same manner as Toner 4 except that the external additive used in Production of Toner 4 is changed to R972 (produced by Nippon Aerosil Co., Ltd.).

Toner 24 obtained has $D_{50V}$ of 5.8 μm, $GSD_V$ of 1.22, a glass transition temperature of 53° C., and a shape factor SF1 of 133. Also, the ratio of the amounts of a carboxyl group and its salt between the toner surface and the entire toner is 0.04, and Nt/St is 12.5.

(Production of Carrier 1)

| | |
|---|---|
| Ferrite (produced by Powdertech Co., Ltd., volume average particle diameter: 50 μm, shape factor SF1 = 120) | 100 parts |
| Methyl methacrylate-perfluorooctylethyl methacrylate copolymer (copolymerization ratio: 85:15, weight average molecular eight: 75,000, produced by Soken Chemical & Engineering Co., Ltd.) | 1.2 parts |
| Toluene | 500 parts |

These are charged into a heating kneader and mixed at 80° C. and after 1 hour, the inside is pressure-reduced to remove toluene by distillation. After the removal by distillation, the residue is cooled to 25° C. and sieved through a 105-μm mesh to obtain Carrier 1. The shape factor SF1 of Carrier 1 is 121.

(Production of Carrier 2)

| | |
|---|---|
| Ferrite (produced by Powdertech Co., Ltd., volume average particle diameter: 50 μm, shape factor SF1 = 120) | 100 parts |
| Curable silicone resin (SR2420, produced by Dow Corning Toray Silicone Co., Ltd., solid content: 20%) | 7.5 parts |
| Toluene | 492.5 parts |

These are charged into a heating kneader and mixed at 80° C. and after 1 hour, the inside is pressure-reduced to remove toluene by distillation. After the removal by distillation, the pressure is returned to atmospheric pressure, and the mixture is heated at 150° C., left standing with stirring for 60 minutes, then cooled to 25° C. and sieved through a 105-μm mesh to obtain Carrier 2. The shape factor SF1 of Carrier 2 is 121.

(Production of Carrier 3)

Carrier 3 is obtained in the same manner as Carrier 1 except that in Production of Carrier 1, the methyl methacrylate-perfluorooctylethyl methacrylate copolymer is changed to polymethyl methacrylate (produced by Soken Chemical & Engineering Co., Ltd., weight average molecular weight: 80,000). The shape factor SF1 of Carrier 3 is 121.

<Production of Developer>

The carrier and the toner in the combination shown in Table 1 are charged into a V-blender at a weight ratio of 95:5 and stirred for 20 minutes to obtain an electrostatic image developer.

TABLE 1

| | Toner | Binder Resin Particle Liquid Dispersion Added Afterward | Carrier | Difference of SF1 | $C_A/C_B$ | Nt/St |
|---|---|---|---|---|---|---|
| Example 1 | 1 | 1 | 1 | 2 | 0.04 | 12.5 |
| Example 2 | 2 | 1 | 1 | 4 | 0.04 | 12.5 |
| Example 3 | 3 | 1 | 1 | 7 | 0.04 | 12.5 |
| Example 4 | 4 | 1 | 1 | 12 | 0.04 | 12.5 |
| Example 5 | 5 | 1 | 1 | 12 | 0.04 | 12.5 |
| Example 6 | 6 | 1 | 1 | 12 | 0.04 | 12.5 |
| Example 7 | 7 | 1 | 1 | 12 | 0.04 | 12.5 |
| Example 8 | 8 | 1 | 1 | 18 | 0.04 | 12.5 |
| Example 9 | 9 | 1 | 1 | 22 | 0.04 | 12.5 |

TABLE 1-continued

| | Toner | Binder Resin Particle Liquid Dispersion Added Afterward | Carrier | Difference of SF1 | $C_A/C_B$ | Nt/St |
|---|---|---|---|---|---|---|
| Example 10 | 11 | 3 | 1 | 12 | 0.024 | 12.5 |
| Example 11 | 12 | 4 | 1 | 13 | 0.093 | 12.5 |
| Example 12 | 13 | 5 | 1 | 13 | 0.18 | 12.5 |
| Example 13 | 16 | 8 | 1 | 10 | 0.04 | 1.2 |
| Example 14 | 17 | 9 | 1 | 10 | 0.04 | 9.1 |
| Example 15 | 18 | 10 | 1 | 10 | 0.04 | 14.6 |
| Example 16 | 20 | 13 | 1 | 14 | 0.04 | 11.5 |
| Example 17 | 21 | 14 | 1 | 9 | 0.04 | 11.1 |
| Example 18 | 22 | 15 | 1 | 13 | 0.04 | 10.3 |
| Example 19 | 23 | 16 | 1 | 13 | 0.04 | 10.5 |
| Example 20 | 24 | 1 | 1 | 12 | 0.04 | 12.5 |
| Example 21 | 4 | 1 | 2 | 12 | 0.04 | 12.5 |
| Example 22 | 4 | 1 | 3 | 12 | 0.04 | 12.5 |
| Comparative Example 1 | 10 | 2 | 1 | 12 | 0 | 12.5 |
| Comparative Example 2 | 14 | 6 | 1 | 13 | 0.21 | 12.5 |
| Comparative Example 3 | 15 | 7 | 1 | 10 | 0.04 | 0.5 |
| Comparative Example 4 | 19 | 11 | 1 | 10 | 0.04 | 17 |

The electrostatic image developers obtained each is fed in a developing machine of modified DocuCentre Color 320CP (manufactured by Fuji Xerox Co., Ltd.) (modified so that an image can be output while the developer stays in one developing machine), and an image is output using Test Chart No. 8 (image coverage: 15%) by SEPJ. The paper sheet is (J Paper) produced by Fuji Xerox Co., Ltd.

In the evaluation, 2,000 sheets are output in an environment of an ambient temperature of 10° C. and a humidity of 20%, the developer is left standing under the conditions of an ambient temperature of 30° C. and a humidity of 80% for 12 hours, 100 sheets are again output, and the conditions are returned to an environment of an ambient temperature of 10° C. and a humidity of 20%. This cycle is repeated to output 10,000 sheets and by checking the fogging of the output image with an eye, the number of sheets output until fogging disappears is determined. Thereafter, 1 sheet is output, and the reduction in the image density from that of the first sheet is determined as the ratio to the image density of the first sheet and expressed in %. This operation is repeated to output 16,000 sheets.

Incidentally, at the transfer from the environment of an ambient temperature of 10° C. and a humidity of 20% to the environment of an ambient temperature of 30° C. and a humidity of 80%, the developer is of course sealed in a bag or the like so as to prevent dew condensation. The sheets output for checking the fogging and image density in the environment of an ambient temperature of 30° C. and a humidity of 80% are not included in the number of sheets output. Also, when the level of rating described later falls short of the goal, the evaluation is stopped. The goal is as follows.

The goal is that the number of sheets output until fogging cannot be confirmed is 10 or less and a reduction ratio of 90% or more in the image density based on the first sheet is achieved even after outputting 10,000 sheets. Thereafter, the fogging and image density are checked every 2,000 sheets, that is, when 12,000 sheets, 14,000 sheets and 16,000 sheets are output.

The results are shown in Table 2.

TABLE 2

| | 10,000 Sheets | | 12,000 Sheets | | 14,000 Sheets | | 16,000 Sheets | |
|---|---|---|---|---|---|---|---|---|
| | Fogging | Reduction Ratio of Density | Fogging | Reduction Ratio of Density | Fogging | Reduction Ratio of Density | Fogging | Reduction Ratio of Density |
| Example 1 | 3 sheets | 98% | 5 sheets | 95% | 8 sheets | 92% | 12 sheets | — |
| Example 2 | 2 sheets | 98% | 4 sheets | 96% | 5 sheets | 92% | 9 sheets | 88% |
| Example 3 | 1 sheet | 99% | 2 sheets | 98% | 4 sheets | 94% | 8 sheets | 91% |
| Example 4 | 1 sheet | 99% | 1 sheet | 99% | 2 sheets | 97% | 3 sheets | 96% |
| Example 5 | 1 sheet | 99% | 1 sheet | 99% | 2 sheets | 96% | 4 sheets | 95% |
| Example 6 | 1 sheet | 98% | 1 sheet | 98% | 1 sheet | 97% | 2 sheets | 96% |
| Example 7 | 1 sheet | 99% | 1 sheet | 99% | 2 sheets | 96% | 4 sheets | 94% |
| Example 8 | 2 sheets | 98% | 2 sheets | 97% | 3 sheets | 94% | 8 sheets | 90% |
| Example 9 | 2 sheets | 98% | 2 sheets | 97% | 3 sheets | 92% | 15 sheets | — |
| Example 10 | 2 sheets | 97% | 5 sheets | 94% | 8 sheets | 90% | 10 sheets | 85% |
| Example 11 | 5 sheets | 95% | 7 sheets | 94% | 9 sheets | 92% | 20 sheets | — |
| Example 12 | 9 sheets | 92% | 15 sheets | — | — | — | — | — |
| Example 13 | 3 sheets | 91% | 5 sheets | 85% | — | — | — | — |
| Example 14 | 2 sheets | 95% | 3 sheets | 93% | 5 sheets | 90% | 8 sheets | 85% |
| Example 15 | 2 sheets | 96% | 2 sheets | 95% | 4 sheets | 93% | 6 sheets | 90% |
| Example 16 | 1 sheet | 99% | 2 sheets | 97% | 6 sheets | 94% | 9 sheets | 87% |
| Example 17 | 1 sheet | 99% | 2 sheets | 97% | 3 sheets | 95% | 6 sheets | 91% |
| Example 18 | 1 sheet | 99% | 2 sheets | 96% | 4 sheets | 90% | 6 sheets | 82% |
| Example 19 | 1 sheet | 99% | 2 sheets | 95% | 6 sheets | 94% | 9 sheets | 91% |
| Example 20 | 3 sheets | 99% | 5 sheets | 97% | 8 sheets | 96% | 10 sheets | 94% |
| Example 21 | 1 sheet | 98% | 2 sheets | 98% | 2 sheets | 95% | 5 sheets | 93% |
| Example 22 | 1 sheet | 99% | 2 sheets | 96% | 2 sheets | 93% | 15 sheets | — |
| Comparative Example 1 | 25 sheets | — | — | — | — | — | — | — |
| Comparative Example 2 | 9 sheets | 81% | — | — | — | — | — | — |
| Comparative Example 3 | 3 sheets | 70% | — | — | — | — | — | — |
| Comparative Example 4 | 15 sheets | — | — | — | — | — | — | — |

What is claimed is:

1. An electrostatic image developing toner comprising a binder resin; and a colorant, and satisfying following conditions (1) and (2):

$$0.02 \leqq C_A/C_B \leqq 0.20 \quad (1)$$

$$1 \leqq Nt/St \leqq 15 \quad (2)$$

wherein $C_A$ represents an amount of a carboxyl group and its salt on a surface of the toner, $C_B$ represents an amount of a carboxyl group and its salt in the entire toner, Nt represents an amount of a nitrogen element on the surface of the toner, and St represents an amount of a sulfur element on the surface of the toner, and wherein the binder resin comprises:

a unit derived from a nitrogen-containing aromatic polymerizable monomer; and a unit derived from a nitrogen-containing aliphatic polymerizable monomer.

2. The electrostatic image developing toner according to claim 1, wherein the nitrogen-containing aromatic polymerizable monomer comprises:

an ethylenically unsaturated bond conjugated to an aromatic ring; and a nitrogen atom.

3. The electrostatic image developing toner according to claim 2, wherein the binder resin comprises, in a side chain thereof, the nitrogen atom of the nitrogen-containing aromatic polymerizable monomer.

4. The electrostatic image developing toner according to claim 1, having a shape factor SF1 of from about 120 to about 140.

5. The electrostatic image developing toner according to claim 1, further comprising:

an external additive that comprises an oxide containing a nitrogen atom.

6. The electrostatic image developing toner according to claim 1, having $GSD_p$ of about 1.40 or less and 1.20 or more, the $GSD_p$ being represented by a following formula:

$$GSD_p = \{(D_{84p})/(D_{16p})\}^{0.5}$$

wherein $D_{16p}$ represents a 16% diameter in terms of the number of toner particles accumulated from a smaller particle diameter side, and $D_{84p}$ represents a 84% diameter in terms of the number of toner particles accumulated from a smaller particle diameter side.

7. The electrostatic image developing toner according to claim 1, wherein the sulfur element on the surface of the toner is contained as a mercapto group (—SH) or a thioether bond (—S—).

8. The electrostatic image developing toner according to claim 1, wherein the binder resin has a glass transition temperature of from about 50° C. to about 70° C.

9. The electrostatic image developing toner according to claim 1, further comprising:

a releasing agent.

10. The electrostatic image developing toner according to claim 9, wherein the releasing agent is contained in an amount of from about 1 wt % to about 20 wt % based on a total amount of toner particles.

11. An electrostatic image developer comprising:

the electrostatic image developing toner according to claim 1; and a carrier.

12. The electrostatic image developer according to claim 11, wherein the carrier comprises at least one of a fluorine atom and a silicon atom.

13. The electrostatic image developer according to claim 11, wherein a shape factor SF1 of the carrier and a shape factor SF1 of the toner differ by from about 5 to about 20.

14. A toner cartridge comprising:

the electrostatic image developing toner according to claim 1.

15. A process cartridge comprising:

a latent image carrier; and at least one member selected from the group consisting of:

an electrically charging device that electrically charges the latent image carrier, a developing device that develops an electrostatic latent image formed on the latent image carrier with a developer to form a toner image, and a cleaning device that removes a toner remaining on a surface of the latent image carrier, wherein the developer is the electrostatic image developer according to claim 11.

16. An image forming apparatus comprising:

a latent image carrier;

an electrically charging device that electrically charges the latent image carrier;

an exposure device that exposes the electrically charged latent image carrier to form an electrostatic latent image on the latent image carrier;

a developing device that develops the electrostatic latent image with a developer to form a toner image; and a transfer device that transfers the toner image onto a recording material from the latent image carrier, wherein the developer is the electrostatic image developer according to claim 11.

17. The electrostatic image developing toner according to claim 1, wherein the nitrogen-containing aromatic polymerizable monomer has an ethylenically unsaturated bond conjugated to an aromatic ring.

18. The electrostatic image developing toner according to claim 1, wherein the nitrogen-containing aromatic polymerizable monomer is selected from the group consisting of aminostyrene, nitrostyrene, cinnamamide, and cinnamonitrile.

* * * * *